United States Patent [19]

Lawson et al.

[11] Patent Number: 4,773,245

[45] Date of Patent: Sep. 27, 1988

[54] STRIP GUIDING APPARATUS FOR DOWNCOILERS

[75] Inventors: Kenneth T. Lawson, Hathersage; Bela I. Bathory, Wales, both of United Kingdom

[73] Assignee: Davy McKee (Sheffield) Limited, Sheffield, England

[21] Appl. No.: 36,051

[22] Filed: Apr. 8, 1987

[30] Foreign Application Priority Data

Apr. 8, 1986 [GB] United Kingdom ..... 8608494

[51] Int. Cl.[4] ..... B21C 47/04

[52] U.S. Cl. ..... 72/148

[58] Field of Search ..... 72/146, 148, 371; 226/17, 19, 20, 21, 22, 23; 242/57.1

[56] References Cited

U.S. PATENT DOCUMENTS

| | | | |
|---|---|---|---|
| 2,842,361 | 7/1958 | Miller | 226/21 |
| 3,107,036 | 10/1963 | Richards et al. | 226/22 X |
| 3,491,562 | 1/1970 | Kajiwara | 226/21 X |
| 3,587,274 | 6/1971 | Rotter | 72/148 |
| 3,592,372 | 7/1971 | James et al. | 226/22 |

FOREIGN PATENT DOCUMENTS

| | | | |
|---|---|---|---|
| 223373 | 6/1985 | German Democratic Rep. | 72/146 |
| 2032626 | 3/1971 | Fed. Rep. of Germany | 226/21 |
| 8112755 | 4/1981 | Fed. Rep. of Germany . | |
| 45-37216 | 11/1970 | Japan | 226/21 |
| 56-28151 | 3/1981 | Japan | 226/21 |

*Primary Examiner*—E. Michael Combs

*Attorney, Agent, or Firm*—Foley & Lardner, Schwartz, Jeffery, Schwaab, Mack, Blumenthal & Evans

[57] ABSTRACT

In an arrangement for coiling metal strip on a downcoiler, the strip is directed to the downcoiler by a pair of pinch rolls and one or both of the rolls are used to steer the strip to a desired position on the mandrel so that a coil with tidy vertical sides is formed on the mandrel. One roll of the pair of pinch rolls may be skewed with respect to the other roll or both rolls may be skewed to the direction of travel of the strip material.

14 Claims, 3 Drawing Sheets

STRIP GUIDING APPARATUS FOR DOWNCOILERS

BACKGROUND OF THE INVENTION

This invention relates to the rolling of metal strip and in particular to the guiding of the strip to a downcoiler where it is coiled into a coil of a convenient size.

In FIG. 1 of the accompanying drawings, a conventional layout at the exist end of a hot strip mill is shown. Strip S leaving the last stand 1 of the hot strip mill passes along a run-out table where it is water cooled and it then pases through a pinch roll unit 3 which deflects the head end of the strip down to the downcoiler 5 where it is gripped and wound into the form of a coil. The plane containing the longitudinal axes of the rolls of the pinch roll unit 3 is set at a slight angle to the vertical so that the rolls turn the head end of the strip down between guiding deflector plates 7 to ensure that the head end is fed correctly to the mandrel of the downcoiler. Usually there are two or more downcoiles and strip can be coiled on either of these downcoilers. An additional pinch roll unit 3' is associated with a second downcoiler (not shown in FIG. 1).

In use, both pinch roll units and downcoilers are driven. When the downcoiler 5 is employed, it is first necessary to close the rolls of the pinch unit 3 to their working position so that the gap between the pinch rolls is of the order of, and usually slightly less than, the thickness of the incoming strip. The pinch rolls are rotated at a speed slightly faster than that of the incoming strip so that, when the head end of the strip is gripped by the pinch roll unit, a slight tension is imparted to the strip. Similarly, the downcoiler mandrel is rotated at a speed faster than the incoming strip in order to tension the strip. Once the head end of the strip has been gripped by the mandrel, the mandrel motor is controlled to apply a tension to the strip which is appropriate to the width and thickness of the strip. Just before the tail end of the strip leaves the last strand of the finishing mill, the tension applied by the pinch roll unit is increased until it is roughly equal to the tension being applied by the downcoiler mandrel so that the coiling tension in the strip is maintained. Side guides 9 are fitted on the run-out table, on opposite sides of the strip path, and these guides are normally set slightly wider than the strip width until the head end of the strip has been gripped by the downcoiler but, once tension has been established, the side guides are brought close to the edges of the strip to ensure that the coil on the mandrel is built up with straight sides.

When the second downcoiler is in use, the pinch rolls of the unit 3 are opened wide so that the head end of the strip passes unhindered between these rolls to the pinch roll unit 3' associated with the second downcoiler.

The side guides 9 suffer from rapid wear by abrasion from the edges of the strip. Wear plates are fitted to the guides and these can be changed rapidly. However, provision of a large number of wear plates is expensive and there is the further disadvantage that the edges of the strip can be damaged.

SUMMARY OF THE INVENTION

It is an object of the present invention to be able to steer metal strip to a desired position relative to the downcoiler without the use of side guides.

According to the present invention, an arrangement for coiling metal strip comprises a downcoiler having a rotatable mandrel and a pair of pinch rolls positioned upstream of the downcoiler, the pinch rolls being employed to steer the strip to a desired position on the mandrel.

In this way, a coil having flat, parallel, sides can be formed on the mandrel of the downcoiler. It may only be necessary to use one of the pair of pinch rolls to steer the strip as it passes between the rolls but, alternatively, both pinch rolls acting as a unit may be employed to steer the strip.

BRIEF DESCRIPTION OF THE DRAWINGS

In order that the invention may be more readily understood, it will now be described, by way of example only, with reference to FIGS. 2–7 of the accompanying drawings in which.

DETAILED DESCRIPTION OF THE PREFERRED EMBODIMENTS

Figure 2A:
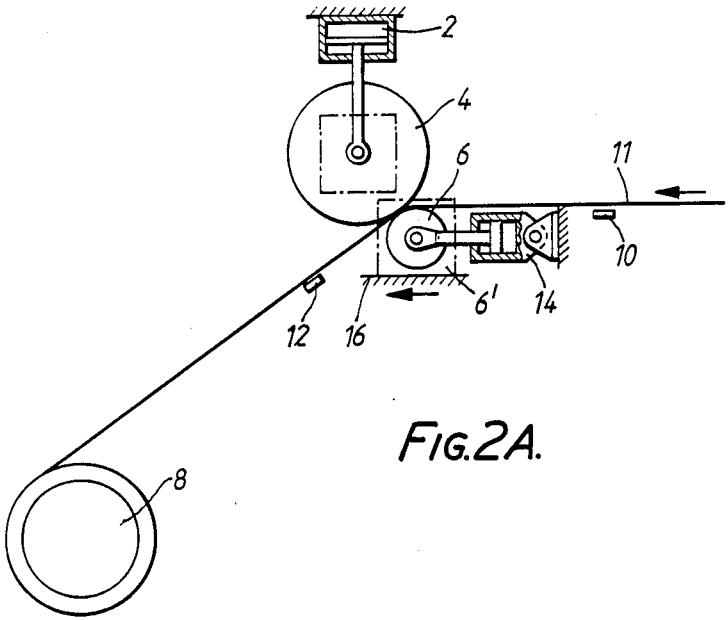
FIGS. 2A and 2B show diagrammatically alternative forms of apparatus in which one pinch roll is employed to steer hot strip onto the mandrel of a down coiler.
Figure 2B:
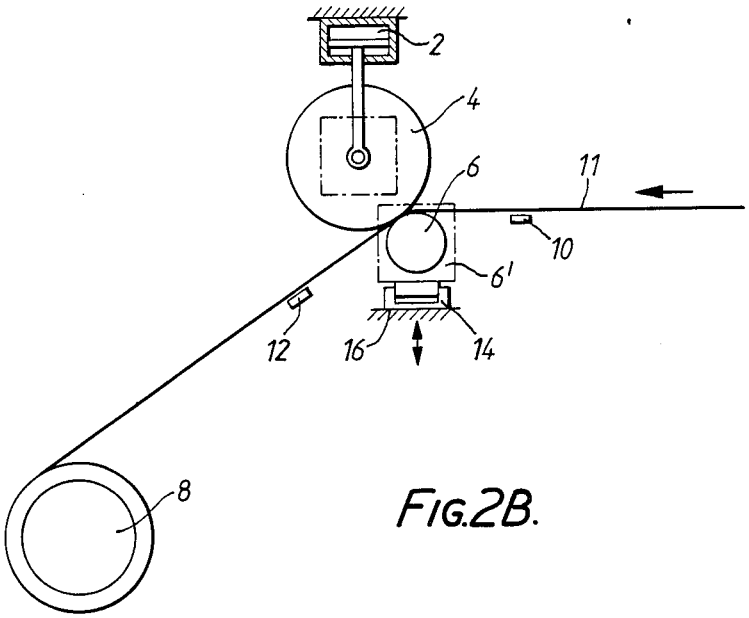

Referring to FIGS. 2A and 2B, hot metal strip issuing from the last stand of a rolling mill is indicated by reference 11. After the strip has been cooled by means well known: it is wound onto the mandrel 8 of a down coiler. Close to and upstream of the down coiler there is a pinch roll unit having a pair of rolls 4, 6 of different diameters. The rolls are supported in bearing chock assemblies and the roll 4 is loaded against the roll 6 by a pair of air cylinders 2 which are connected to the bearing chock assemblies of the roll.

In the arrangement shown in FIG. 2A the bearing chock assemblies 6' at the ends of the roll 6 are slidable on a base surface 16 and are connected through a pair of substantially horizontal links to a pair of servo actuators 14 which are pivotably secured to a foundation. By energising the servo actuators 14, the roll 6 can be caused to move horizontally relative to the surface 16. By actuating one servo actuator to a greater extent than the other, the longitudinal axis of roll 6 can be skewed with respect to that of the mandrel and also with respect to that of the roll 4.

The cylinders 2 allow the gap between the rolls to be opened during threading and after the strip has been threaded between the rolls, the rolls 4, 6 are brought into engagement with opposite sides of the strip. The roll 4 is thereafter rotatable about a horizontal axis and the smaller diameter roll 6 is rotatable about an axis which is normally parallel to the axis of rotation of the roll 4 but which can be skewed somewhat in the horizontal plane. When the axes of rolls 4, 6 are parallel, in theory the strip will remain on a particular path between the two rolls. In practice however, because of variations in the gauge and shape of the strip there is a tendency for the strip to move one way or the other in the direction parallel to the longitudinal axis of the rolls. By skewing the axis of the roll 6 relative to that of the roll 4 there is no longer a uniform pressure variation across the width of the strip and the strip is caused to track relative to the longitudinal axis of the rolls so that the strip takes up a different path as it approaches the mandrel.

In the arrangement shown in FIG. 2B, a pair of servo actuators 14 bear against the bearing chock assemblies 6' of the roll 6 and also against a horizontal foundation surface 16. Thus by operating the actuators 14, the roll 6 is raised and lowered. If both actuators are operated equally then the longitudinal axis of the roll 6 remains parallel with that of the roll 4 but if the actuator at one end of roll 6 is operated to a greater extent than that at the other end of the roll then the longitudinal axis of the roll 6 is skewed in a vertical plane with respect to that of the roll 4. When skewing occurs the pressure applied to the strip by the two rolls will remain substantially uniform along the width of the strip but the tension distribution between the roll 6 and mandrel 8 will change across the strip and consequently the strip moves sideways so that it can be caused to take up a particular path as it approaches the mandrel 8.

In both of the embodiments of the invention shown in FIGS. 2A and 2B, edge detectors 10 are provided upstream of the pinch rolls and are arranged to detect the lateral edges of the strip material as it approaches the pinch rolls and, if it has tended to move away from the desired path between the pinch rolls, the detectors 10 detect the movement away from the desired path and the actuators are controlled accordingly in order the steer the strip onto the correct path between the rolls 4, 6. If desired further edge detectors 12 may be positioned downstream of the pinch rolls and they are used to check the position of the strip relative to the rolls and to provide further adjustment of the servo actuators if this is necessary in order to bring the strip exactly onto the desired path.

It is of course possible to combine the arrangement shown in FIGS. 2A and 2B with pressure control. When the pressure applied to the strip by cylinders 2 is different from one side of the strip to the other, it additionally helps to steer the strip to the desired path.

Figure 3:
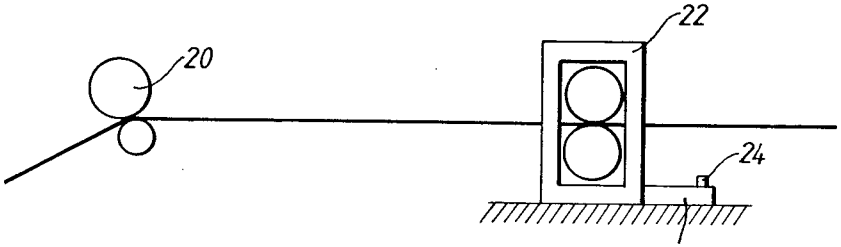

Referring now to FIG. 3, a pair of conventional pinch rolls 20 are positioned upstream of the downcoiler (not shown) and a steering pinch roll unit 22 is positioned upstream of the pinch rolls 20. The pinch roll unit 22 consists of a pair of housings supporting a pair of pinch rolls and the housings are mounted on a base 23 which carries a vertical pivot pin 24. A double acting actuator (not shown) is connected to the base 23 to enable the housing and base to pivot about the vertical pivot pin 24. If the strip approaching the pinch rolls 20 and hence the mandrel moves off of the desired path then a small displacement of the pinch roll unit 22 about the pin 24 will apply forces to the strip which will cause it to move sideways onto the desired path. In use, the gap between the rolls of the steering pinch unit will be set slightly less than the strip thickness so that the roll will grip the strip as soon as the strip enters between them. The rolls are driven by in-built motors (not shown) to spin the rolls up to the strip speed before the strip is received. Alternatively, the rolls may be left open until the strip has entered and become gripped by the pinch roll unit 20 after which the rolls of the steering roll unit 22 may be brought into engagement with opposite faces of the strip.

Figure 1:
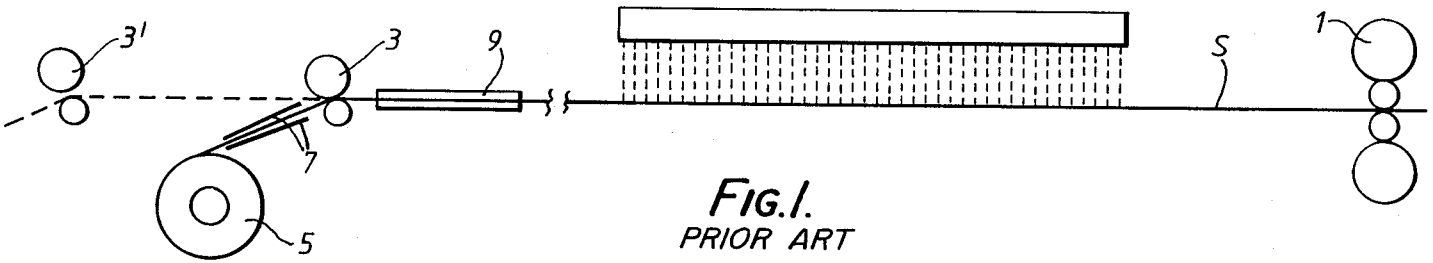
FIG. 1. PRIOR ART
FIG. 1 shows a conventional layout at the exit end of a hot strip mill.
Figure 4:
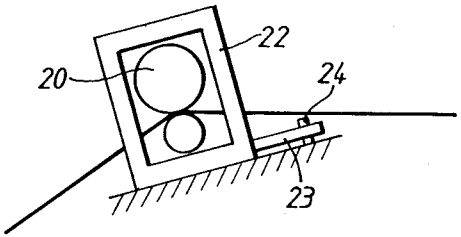
FIGS. 3 and 4 show diagrammatically alternative forms of pinch roll units which are employed to steer hot strip onto the mandrel of a down coiler.

In the FIG. 4 arrangement the conventional pinch rolls 20 and the steering pinch roll unit 22 as shown in FIG. 3 are combined into a single unit in which the housing and base 23 are supported on an inclined surface and the unit is pivotable about a pin 24 extending normal to the surface. In use, to steer the strip onto a predetermined path to the coiler the unit is pivoted about the pin 24 in order to urge the strip sideways in one direction or another in order take up the desired path.

Figure 5:
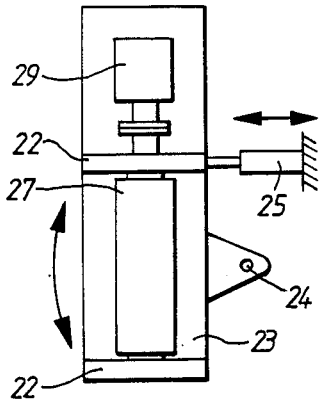
FIGS. 5, 6 and 7 are plan views of alternative pinch roll units.
Figure 6:
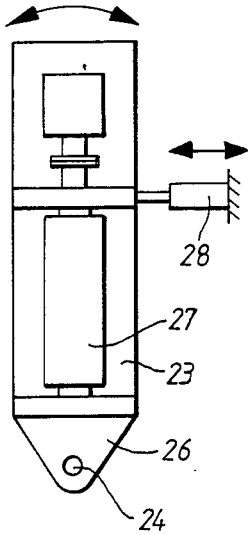
Figure 7:
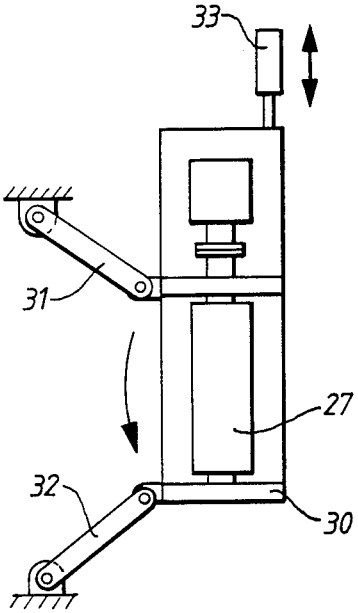

FIGS. 5, 6 and 7 show alternative forms of steerable pinch roll units. The arrangement shown in FIG. 5 is particularly suitable for use in the embodiment of the invention shown in FIGS. 3 and 4. Referring to FIG. 5, the rolls 27 are shown mounted in the housings 22 and are rotated by individual drive motors 29. The base 23 is pivoted about the pin 24 by a piston-cylinder device 25 which is connected to the base and to a foundation. FIG. 6 shows an alternative arrangement in which the unit is pivotable about a pin 24 extending through a lug 26 arranged on the base at one end of the rolls. The housing is pivoted by way of a piston-cylinder device 28.

FIG. 7 shows an arrangement in which the unit 30 is pivotably connected to opposite ends to a pair of links 31, 32 which are fixed at their outer ends. The links permits the unit to be displayed by an actuator 33 such that the unit is moved to a limited extent in the direction of the length of the rolls 27 and can also be made to become skewed in the plane of the strip passing between the rolls. In all these embodiments of the invention the amount of movement made by the actuators will normally be within the range of $\pm\frac{1}{4}''$ about the mean position.

We claim:

1. An arrangement for coiling hot metal strip moving in the direction of its length in a substantially horizontal plane comprising:

a downcoiler having a rotatable horizontal mandrel and means for rotating the mandrel; and a pinch roll unit positioned upstream of the downcoiler to steer the strip to a desired position on the mandrel;

said pinch roll unit comprising a pair of horizontal rolls rotatably mounted in a housing structure, means for rotating the rolls and means for pivoting the structure in a horizontal plane to skew the rolls with respect to the path of travel of the metal strip.

2. An arrangement as claimed in claim 1, wherein the housing structure comprises a pair of spaced apart housings and a base supporting the housings, said base being pivotable about a generally vertically oriented pivot post.

3. An arrangement as claimed in claim 2 in which the pivot post is positioned at one end of the rolls.

4. An arrangement as claimed in claim 2 in which the pivot post is positioned laterally of the longitudinal axes of the rolls.

5. An arrangement as claimed in claim 2, wherein the pivot post is oriented vertically.

6. An arrangement as claimed in claim 2, wherein the pivot post is oriented at an acute angle to the vertical.

7. An arrangement as claimed in claim 2, wherein the pivot post is positioned at one end of the housing structure.

8. An arrangement as claimed in claim 2, wherein the pivot post is positioned near the center of the housing structure.

9. An arrangement as claimed in claim 1, wherein the housing structure comprises a pair of spaced apart housings, a base supporting the housings and a pair of links pivotally connected to the base and to fixed foundations.

10. An arrangement as claimed in claim 1, further comprising means for providing a gap between said horizontal rollers in said pinch roll unit having a width smaller than the thickness of the strip, whereby the strip is firmly gripped by said rollers.

11. An arrangement for coiling hot metal strip moving in the direction of its length in a substantially horizontal plane comprising:

a final stand of rollers in a hot strip mill;

means positioned downstream of said final stand of rollers for cooling the hot metal strip exiting from said stand of rollers;

a first pinch roll unit positioned downstream of the cooling means to steer the strip to a desired position in a horizontal plane, said pinch roll unit comprising a pair of horizontal rolls rotatably mounted in a housing structure, means for rotating the rolls, and means for pivoting the structure in a horizontal plane to skew the rolls with respect to the path of travel of the metal strip; and a downcoiler positioned downstream of said pinch roll unit having a rotatable horizontal mandrel and means for rotating the mandrel.

12. An arrangement as claimed in claim 11, wherein said first pinch roll unit comprises the sole pinch roll unit, and wherein said rollers have central longitudinal axes which lie in a plane that is inclined with respect to vertical, whereby said pinch roll unit serves for steering the strip to a desired position in a horizontal plane and for deflecting the strip out of the horizontal plane to the downcoiler.

13. An arrangement as claimed in claim 11, further comprising a second pinch roll unit positioned downstream of said first pinch roll unit, for deflecting the strip out of the horizontal plane to the downcoiler.

14. An arrangement as claimed in claim 12, wherein the housing structure comprises a pair of spaced apart housings and a base supporting the housings, said base being pivotable about a pivot post oriented at an angle with respect to vertical.

* * * * *